US008626031B2

(12) United States Patent
Toba et al.

(10) Patent No.: US 8,626,031 B2
(45) Date of Patent: Jan. 7, 2014

(54) IMAGE FORMING APPARATUS

(75) Inventors: Shinjiro Toba, Yokohama (JP); Takahito Ueno, Mishima (JP); Shigeo Miyabe, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 717 days.

(21) Appl. No.: 12/893,433

(22) Filed: Sep. 29, 2010

(65) Prior Publication Data

US 2011/0103839 A1 May 5, 2011

(30) Foreign Application Priority Data

Oct. 30, 2009 (JP) ..... 2009-250821
Aug. 30, 2010 (JP) ..... 2010-192392

(51) Int. Cl.
*G03G 15/01* (2006.01)

(52) U.S. Cl.
USPC ..... 399/227

(58) Field of Classification Search
USPC ..... 399/227
See application file for complete search history.

(56) References Cited

U.S. PATENT DOCUMENTS 6,983,115 B2 1/2006 Isobe et al.

FOREIGN PATENT DOCUMENTS

| | | | |
|---|---|---|---|
| JP | 10-221919 | A | 8/1998 |
| JP | 2000-231239 | A | 8/2000 |
| JP | 2003-302807 | A | 10/2003 |
| JP | 2004-126017 | A | 4/2004 |
| JP | 3940919 | B2 | 7/2007 |
| JP | 2008-310304 | A | 12/2008 |
| KR | 10-2004-0028547 | A | 4/2004 |

OTHER PUBLICATIONS

Office Action dated Dec. 20, 2012, in Korean Application No. 10-2010-0103249.

*Primary Examiner* — Walter L Lindsay, Jr.
*Assistant Examiner* — Ruth Labombard
(74) *Attorney, Agent, or Firm* — Fitzpatrick, Cella, Harper & Scinto

(57) ABSTRACT

An image forming apparatus includes an image bearing member; a developing device; and a movable member for rotationally moving the developing device. The movable member includes a rotation shaft member, a first member which is engaged with the rotation shaft member at one end portion, a second member which is engaged with the rotation shaft member at the other end portion, a first guide portion, and a second guide portion. The apparatus further includes a first swingable supporting member for rotatably supporting the movable member at the one end portion; a second swingable supporting member for rotatably supporting the movable member at the other end portion; an urging portion for urging the movable member toward the image bearing member; a first preventing member for preventing movement of the first member; and a second preventing member for preventing movement of the second member.

8 Claims, 15 Drawing Sheets

(a)

(b)

IMAGE FORMING APPARATUS

FIELD OF THE INVENTION AND RELATED ART

The present invention relates to a color electrophotographic image forming apparatus including a plurality of developing devices.

Here, the developing device develops an electrostatic latent image formed on an image bearing member (referred also to as a photosensitive drum) by a developing means to visualize the electrostatic latent image as a toner image, and a developing cartridge includes the developing device and is detachably mountable to the image forming apparatus.

In the image forming apparatus such as a copying machine, a printer or a facsimile machine, the electrostatic latent image formed on the image bearing member is visualized as the toner image by being developed by the developing means.

In a conventional image forming apparatus using an electrophotographic image forming process, the developing device develops the electrostatic latent image formed on the image bearing member by the developing means to visualize the electrostatic latent image as the toner image.

The developing cartridge is prepared by integrally assembling a developer carrying member for developing the electrostatic latent image formed on the image bearing member, a toner accommodating portion for accommodating a developer, and a developing blade for regulating a developer layer thickness into a cartridge which is detachably mountable to an image forming apparatus main assembly.

With respect to such an image forming apparatus, color image forming apparatuses including a movable member in which a plurality of developing cartridges is mountable (hereinafter referred also to as a rotary) and including developing devices of a rotary type have been proposed and commercialized (Japanese Patent No. 3940919, Japanese Laid-Open Patent Application (JP-A) 2003-302807, JP-A Hei 10-221919, and JP-A 2000-231239).

In such a rotary constitution, the developing cartridges are supported and a developing roller of one of the developing cartridges is brought into contact with the photosensitive drum uniformly with respect to a rotational axis direction of the photosensitive drum.

At this time, as shown in FIGS. 6(*a*) and 6(*b*), the image forming apparatus main assembly applies an urging force to the rotary, so that the developing roller is pressed against the photosensitive drum with holes 307*a* and 306*a* as centers of swing.

For that reason, in order to bring the developing roller into contact with the photosensitive drum uniformly as described above, there is a need to enhance dimensional accuracy and supporting rigidity of the rotary and dimensional accuracy and rigidity of the developing cartridges.

However, in the rotary constitution described in the prior art, the following problem arises. When a variation in dimensional accuracy of each of parts, in the case where, e.g., lengths of R1 and R2 as shown in FIG. 6(*a*) are different from each other, a line connecting the center of the hole 307*a* (the swing center) to the center of a developing roller end portion 2*a*L and a line connecting the center of the hole 306*a* (the swing center) to the center of a developing roller end portion 2*a*R provide a relative angular difference β.

As a result, the developing roller end portion 2*a*R contacts a photosensitive drum 3*a* but the developing roller end portion 2*a*L is separated from the photosensitive drum 3*a* as shown in FIGS. 6(*b*) and 6(*c*), so that the developing roller 2*a* does not completely contact the photosensitive drum 3*a*.

Further, as a countermeasure thereto, in the case where the developing roller 2*a* is brought into strong contact with the photosensitive drum 3 with respect to a direction indicated by an arrow Y, a contact pressure of the developing roller 2*a* becomes nonuniform with respect to a longitudinal direction of the photosensitive drum although a gap d is not created. Thus, a contact with (developing nip width) between the developing roller and the photosensitive drum becomes nonuniform with respect to the longitudinal direction of the photosensitive drum, so that there is a possibility that image defect occurs. Therefore, there is a need to effect several dimensional controls in manufacturing.

However, in the prior art, the developing roller is required to be uniformly in contact with the photosensitive drum with respect to the photosensitive drum rotational axis direction. For that purpose, there was a need to enhance processing accuracy of each of parts for holding the developing roller and the photosensitive drum and to enhance positioning of the developing roller relative to the photosensitive drum with high accuracy.

As one measure for that purpose, it is necessary to increase the rigidity of the rotary in which the developing cartridges are mounted. That is, there was a need to select a high-rigidity material or to ensure the rigidity by increasing a thickness of a member for the rotary.

As a result of such a measure, there was a problem that a production cost was increased.

As a constitution for solving the problem, e.g., Japanese Patent No. 3940919 discloses a constitution in which the developing roller is brought into contact with the photosensitive drum uniformly (with respect to the photosensitive drum longitudinal direction) as shown in FIGS. 18 to 20 thereof. However, this constitution is effective only for a constitution in which the developing cartridge is mounted and demounted in the photosensitive drum longitudinal direction but is not suitable for a constitution in which the developing cartridge is mounted and demounted in a radial direction of the rotary.

Further, in the case where a constitution as shown in FIGS. 1 and 2 of JP-A 2003-302807 was selected, there was a problem that the constitution of the rotary was complicated and thus the production cost was increased.

SUMMARY OF THE INVENTION

A principal object of the present invention is to provide an image forming apparatus capable of bringing a developer carrying member into contact with an image bearing member uniformly with respect to a rotational axis direction of the image bearing member with a simple constitution.

Accordingly, an aspect of the present invention is to provide an image forming apparatus comprising:

an image bearing member on which an electrostatic image is to be formed;

a developing device including a developer container for containing a developer, a developer carrying member for developing the electrostatic image with the developer carried thereon, and a contact portion which is contactable to the image bearing member;

a movable member for rotationally moving the developing device mounted therein toward a position in which the developing device opposes the image bearing member, the movable member including a rotation shaft member, a first member which is engaged with the rotation shaft member with play at one end portion of the rotation shaft member with respect to a rotational axis direction of the rotation shaft member, a second member which is engaged with the rotation shaft member with play at the other end portion of the rotation shaft member with respect to the rotational axis direction, a first guide portion which is provided in the first member and with which a first portion to be guided which is provided at one end of the developing device is engageable with play, and a second guide portion which is provided in the second member and with which a second portion to be guided which is provided at the other end of the developing device is engageable with play;

a first swingable supporting member for rotatably supporting the movable member at the one end portion of the rotation shaft member in the movable member and for swingably supporting the movable member relative to a main assembly of the image forming apparatus;

a second swingable supporting member for rotatably supporting the movable member at the other end portion of the rotation shaft member in the movable member and for swingably supporting the movable member relative to the main assembly;

an urging portion for urging the movable member toward the image bearing member;

a first preventing member for preventing movement of the first member in the rotational axis direction; and a second preventing member for preventing movement of the second member in the rotational axis direction.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

General Structure of Image Forming Apparatus

First, an image forming operation of the image forming apparatus according to an embodiment of the present invention will be described with reference to FIG. 1.

Figure 1:
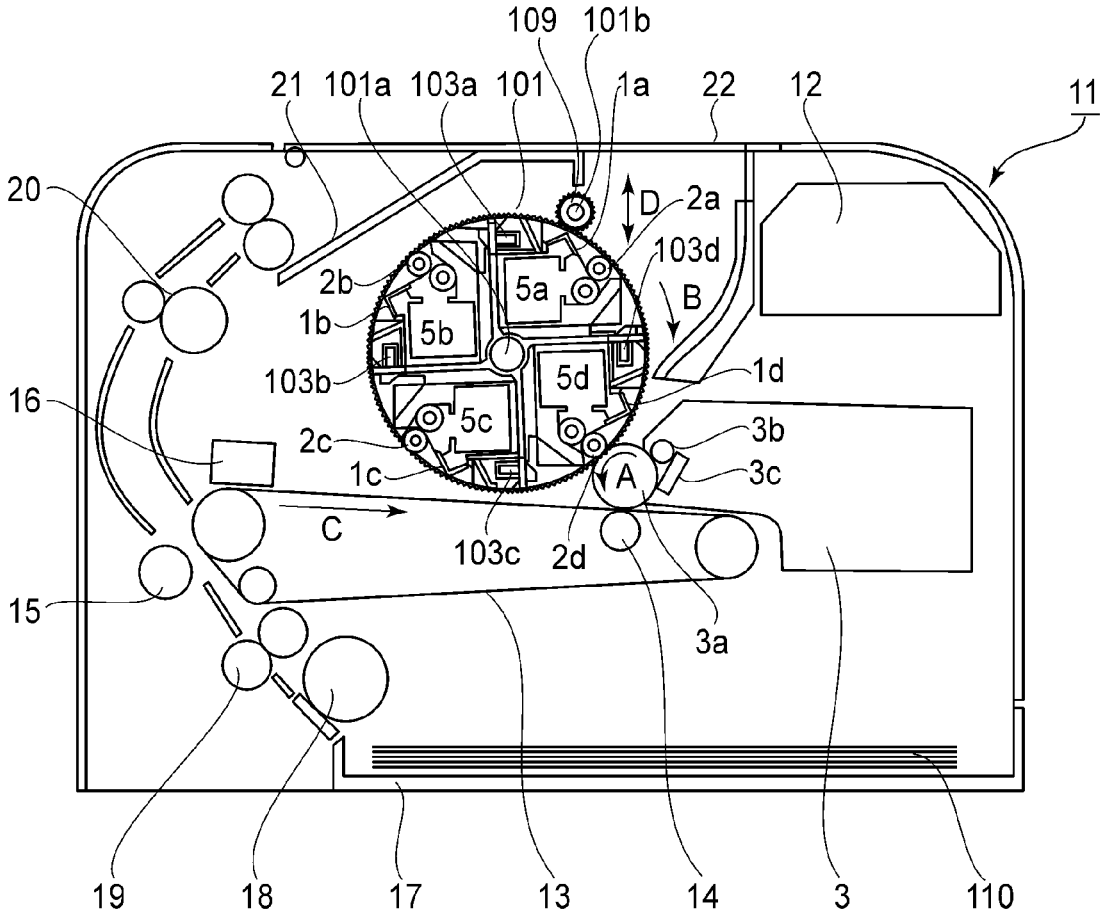
FIG. 1 is a schematic sectional view showing an example of a main assembly of the image forming apparatus according to the present invention.

The image forming apparatus is a four color-based full-color laser beam printer, and FIG. 1 is a sectional view showing a schematic structure thereof.

As shown in FIG. 1, an image forming apparatus 11 includes a photosensitive drum (image bearing member) 3*a*. At a periphery of the photosensitive drum 3*a*, a charging means 3*b* for uniformly charging the photosensitive drum 3*a* and an exposure means 12 for forming a latent image on the photosensitive drum 3*a* by irradiating the surface of the photosensitive drum 3*a* with laser light are disposed. Further, a yellow developing device 5*a*, a magenta developing device 5*b*, a cyan developing device 5*c* and a black developing device 5*d* which are to be used for developing the latent image formed on the photosensitive drum 3*a*, and a cleaning means 3*c* for removing residual toner on the photosensitive drum 3*a* are disposed.

In this embodiment, the photosensitive drum 3*a*, the charging means 3*b* and the cleaning means 3*c* are integrally constituted and are assembled into a drum cartridge 3 which is detachably mountable to the image forming apparatus 11. Each of the photosensitive drum 3*a*, the charging means 3*b* and the cleaning means 3*c* may have an independent constitution or may also have an integral constitution. Further, the photosensitive drum 3*a* may also be fixed to the image forming apparatus main assembly.

The plurality of developing devices is held by a rotary 101 which is a movable member rotatably attached to the image forming apparatus 11. Each of the developing devices may have a constitution in which the developing device cannot be demounted from the rotary 101 or may also be a developing cartridge type in which the developing device is mountable to and demountable from the rotary 101. Incidentally, in this embodiment, by taking the developing device of the developing cartridge type in which the developing device is detachably mountable to the rotary 101 as an example, the developing devices will be described as a yellow developing cartridge 5*a*, a magenta developing cartridge 5*b*, a cyan developing cartridge 5*c* and a black developing cartridge 5*d*.

The rotary 101 has the same developing cartridge holding constitution with respect to each of the yellow developing cartridge 5*a*, the magenta developing cartridge 5*b*, the cyan developing cartridge 5*c* and the black developing cartridge 5*d*. Therefore, in this embodiment, the constitution in which the rotary 101 holds each of the developing cartridges will be described with respect to the yellow developing cartridge 5*a*.

Figure 5:
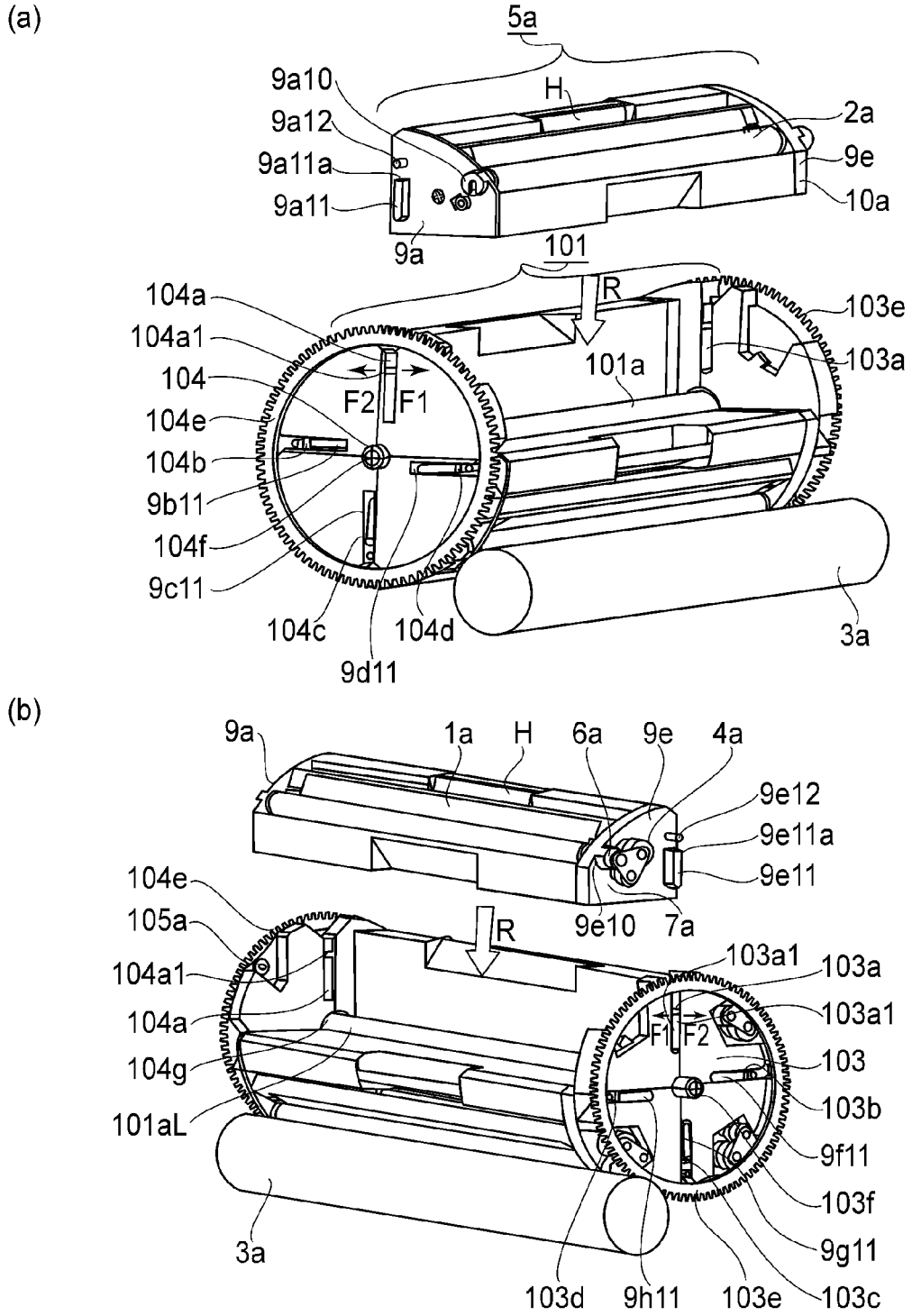
FIGS. 5(*a*) and 5(*b*) are schematic views for illustrating mounting and demounting of the developing cartridge in the present invention.
Figure 6:
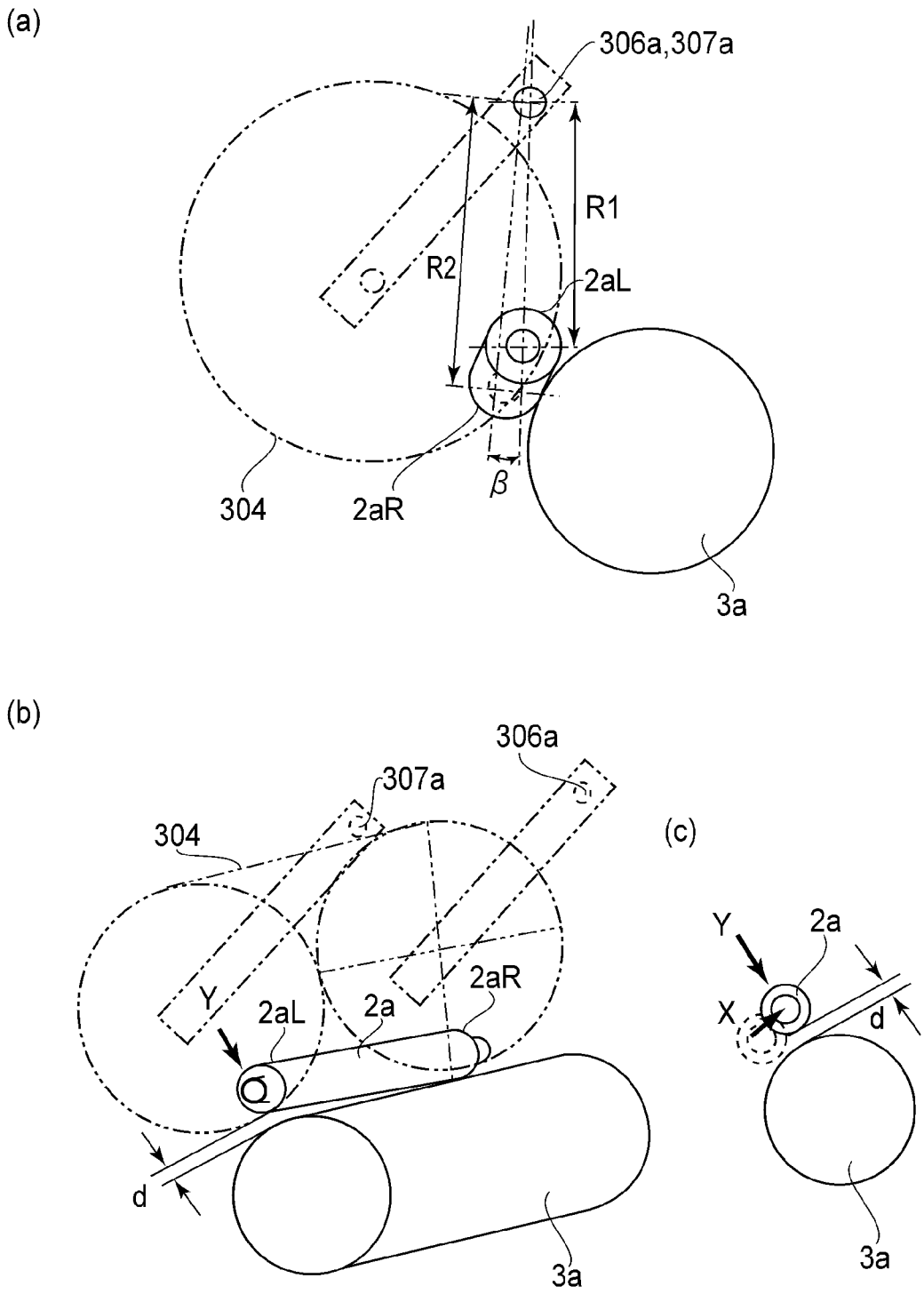
FIGS. 6(*a*) to 6(*c*) are schematic views for illustrating a contact state of a conventional developing cartridge.

As shown in FIGS. 5(*a*) and 5(*b*), the rotary 101 includes a first disk 104 which is a first supporting member (first member) and a second disk 103 which is a second supporting member (second member). The first disk 104 supports a guide portion (first portion to be guided) 9*a*11 which is a first portion to be locked which is provided on one end portion of the developing cartridge (developing device) 5*a*. The second disk 103 supports a guide portion (second portion to be guided) 9e11 which is a second portion to be locked which is provided on the other end portion of the developing cartridge (developing device) 5.

Figure 16:
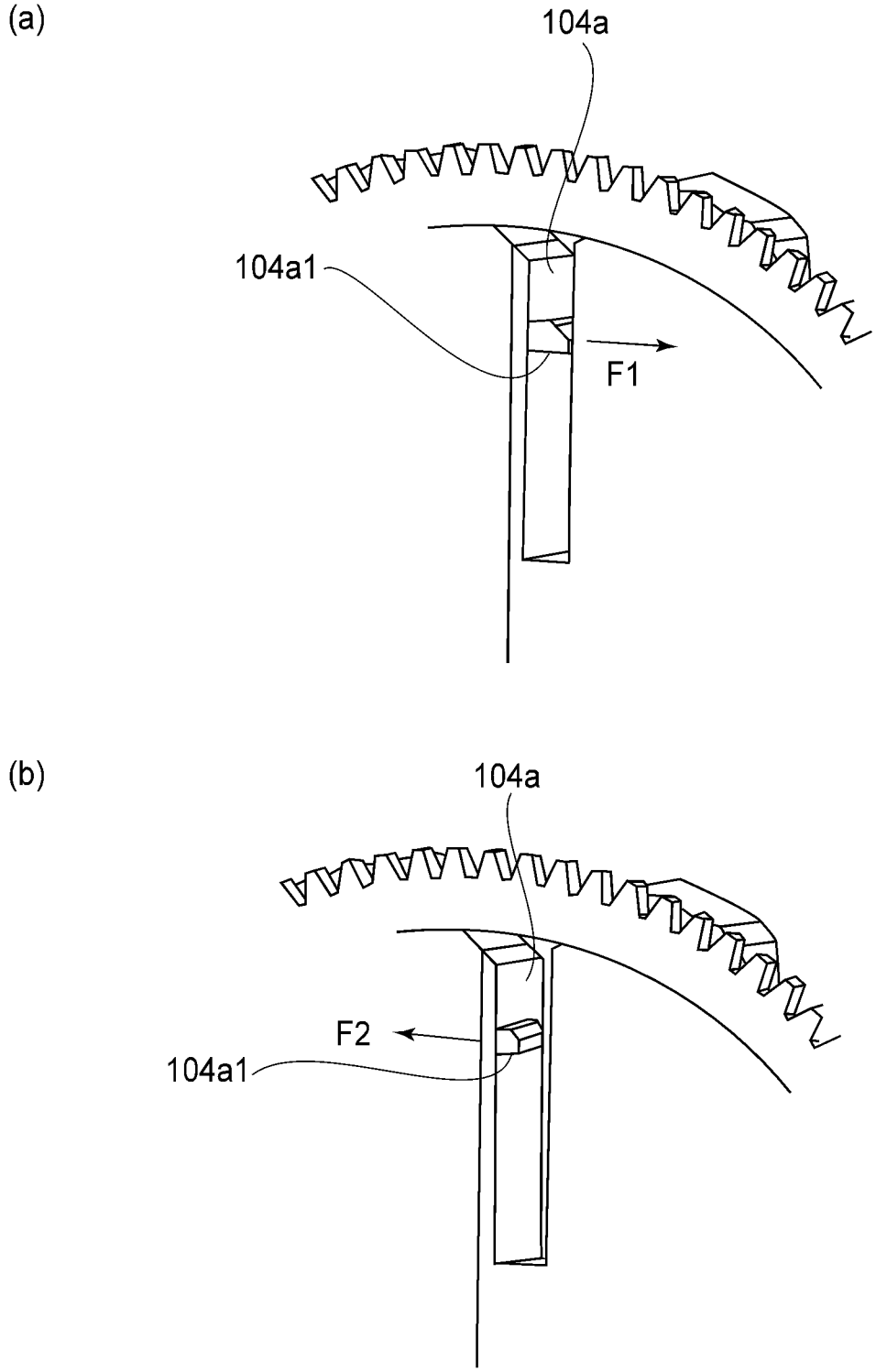
FIGS. 16(*a*) and 16(*b*) are schematic views showing a locking member in the present invention.

Further, the rotary 101 is provided with guide grooves (first guide portion) 104a and (second guide portion) 103a for guiding the developing cartridge 5a to be mounting position when the developing cartridge 5a is mounted in the rotary 101. In a state in which a door 22 (FIG. 1) of the image forming apparatus main assembly is opened, developing cartridge locking members 104a and 103a are retracted in a direction indicated by an arrow F2 in FIG. 5(*a*) and FIG. 16(*b*). Then, the rotary 101 is placed in a state in which the guide portions 9a11 and 9e11 can be received by the guide grooves 104a and 103a, respectively (i.e., a state in which the developing cartridge 5a is not prevented from being mounted in the rotary 101).

Then, a user holds a holding portion H and mounts the developing cartridge 5a in a direction indicated by an arrow R in FIGS. 5(*a*) and 5(*b*). The guide portion 9a11 of the developing cartridge 5a is engaged with the guide groove 104a and the guide portion 9e11 of the developing cartridge 5a is engaged with the guide groove 103a, so that the developing cartridge 5a is guided to the mounting position.

Thus, the developing cartridge 5a reaches a predetermined position with respect to the arrow R direction shown in FIGS. 5(*a*) and 5(*b*) and then when the door 22 (FIG. 1) of the image forming apparatus main assembly is closed, the developing cartridge locking members 104a and 103a move in a direction indicated by an arrow F1 in FIGS. 5(*a*) and 16(*a*).

Thus, a locking surface 103a1 of the developing cartridge locking member 103a and a locking surface 9e11a of the portion to be locked 9e11 contact each other. Further, the developing cartridge locking member 104a similarly moves in the arrow F1 direction shown in FIGS. 5(*a*) and 16(*a*) by an unshown spring. Then, a locking surface 104a1 of the locking member 104a and a locking surface 9a11a of the guide portion 9a11 contact each other, so that the yellow developing cartridge 5a is prevented from moving in a direction indicated by an arrow D in FIG. 1.

That is, the developing cartridge is held by the rotary 101 (FIGS. 1, 5(*a*) and 5(*b*)), thus being prevented from being detached in a radial direction of rotation of the rotary 101.

Further, in a state in which the door 22 of the image forming apparatus main assembly is opened, the developing cartridge locking member 103a is retracted in the arrow F2 direction in FIG. 5(*b*) in interrelation with an opening operation of the door 22, so that the engagement of the locking surface 9e11 with the locking surface 103a1 is released. Also on an opposite side, similarly, the developing cartridge locking member 104a is retracted in the arrow F2 direction in FIG. 5(*a*) in interrelation with the opening operation of the door 22, so that the engagement of the locking surface 9a11a with the locking surface 104a1 is released and thus the developing cartridge is detachably mountable to the rotary.

Similarly, the magenta developing cartridge 5b, the cyan developing cartridge 5c and the black developing cartridge 5d are provided with guide portions 9b11, 9c11 and 9d11, respectively. These guide portions 9b11, 9c11 and 9d11 are engaged with cartridge locking members 104b, 104c and 104d, respectively, provided in the rotary 101, so that the developing cartridges 5b, 5c and 5d are held by the rotary 101 and thus are prevented from being detached in the radial direction of rotation of the rotary 101.

Further, also with respect to the other end portions, by a similar constitution, the magenta developing cartridge 5b, the cyan developing cartridge 5c and the black developing cartridge 5d are provided with portions to be locked 9f11, 9g11 and 9h11, respectively. These guide portions 9f11, 9g11 and 9h11 are engaged with developing cartridge locking members 103b, 103c and 103d, respectively, provided in the rotary 101, so that the developing cartridges 5b, 5c and 5d are held by the rotary 101 and thus are prevented from being detached in the radial direction of rotation of the rotary 101.

Next, the image forming operation will be described. First, the photosensitive drum 3a is rotated in a direction indicated by an arrow A in FIG. 1. In synchronism with the rotation of the photosensitive drum 3a, an intermediary transfer belt 13 is rotated in a direction indicated by an arrow C in FIG. 1. Then, the surface of the photosensitive drum 3a is uniformly charged by the charging means 3b and at the same time is irradiated with light for a yellow image by the exposure means 12, so that an electrostatic latent image for yellow is formed on the photosensitive drum 3a.

The rotary 101 holds the yellow developing cartridge 5a, the magenta developing cartridge 5b, the cyan developing cartridge 5c and the black developing cartridge 5d. The rotary 101 is rotated about a rotary rotation shaft 101a in a direction indicated by an arrow B in FIG. 1 by a drive transmission mechanism provided in the image forming apparatus 11. By the rotation of the rotary 101, the yellow developing cartridge 5a is disposed at a developing position in which the yellow developing cartridge 5a opposes the photosensitive drum 3a, i.e., is placed in a state shown in FIG. 2.

Then, a potential difference is provided between the photosensitive drum 3a and the developing roller 2a which is the developer carrying member so that a yellow developer is deposited on the latent image formed on the photosensitive drum 3a. As a result, the latent image formed on the photosensitive drum 3a is developed by depositing the yellow developer thereon. That is, a yellow developer image is formed on the photosensitive drum 3a.

Thereafter, by applying a voltage of an opposite polarity to the toner charge polarity to a primary transfer roller 14 disposed inside the intermediary transfer belt 13, the yellow toner image is primary-transferred from the photosensitive drum 3a on to the intermediary transfer belt 13.

In the above-described manner, when the primary transfer of the yellow toner image is completed, the rotary 101 is rotationally moved in the arrow B direction in FIG. 1 by receiving a driving force from the drive transmission mechanism (not shown) of the image forming apparatus 11. Then, the magenta developing cartridge 5b, the cyan developing cartridge 5c and the black developing cartridge 5d are successively positioned at the developing position in which the positioned developing cartridge opposes the photosensitive drum 3a.

Similarly as in the case of yellow, with respect to each of the colors of magenta, cyan and black, the formation of the electrostatic latent image, the development of the electrostatic latent image and the primary transfer are successively performed, so that four color toner images are superposed on the intermediary transfer belt 13.

During this image forming operation, as shown in FIG. 1, a secondary transfer roller 15 is in non-contact with the intermediary transfer belt 13. Further, a cleaning unit 16 for the intermediary transfer belt 13 is also in non-contact with the intermediary transfer belt 13.

Figure 2:
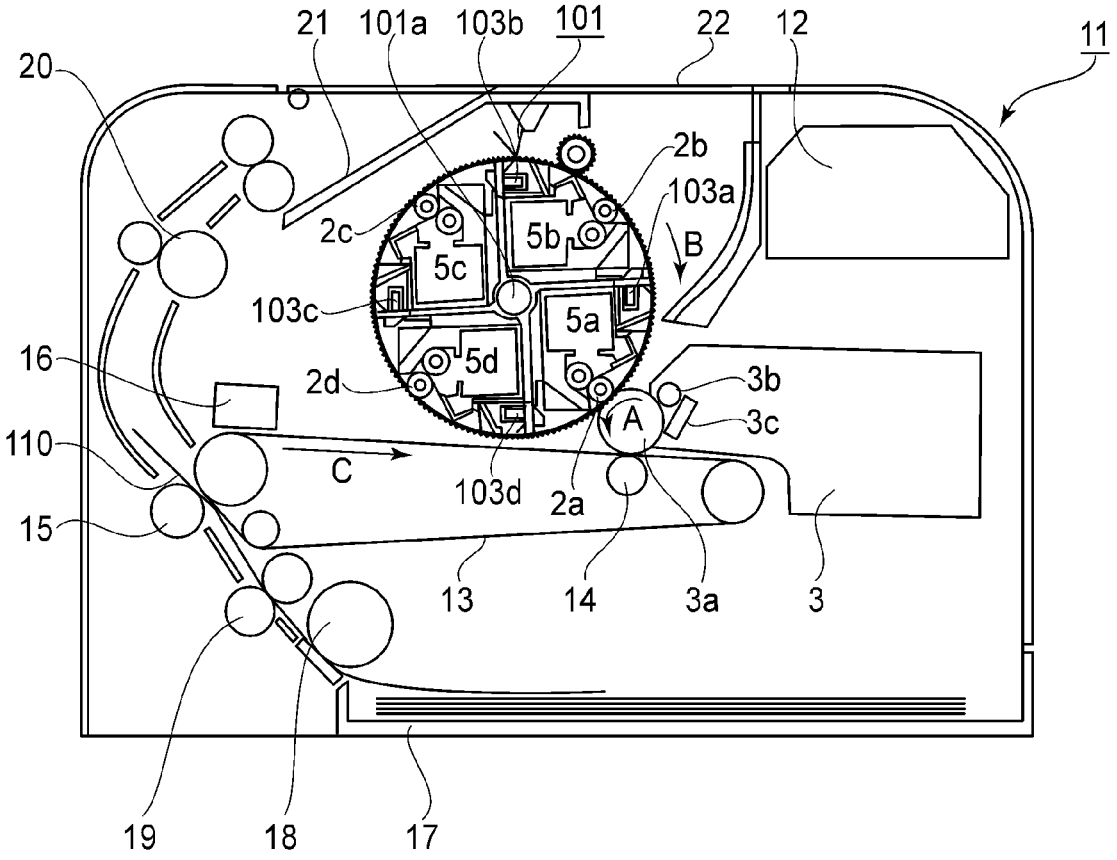
FIG. 2 is a schematic sectional view showing an example of the main assembly of the image forming apparatus according to the present invention during image formation.

On the other hand, sheets 110 which are a recording material (medium) for the toner images are stacked and accommodated in a sheet feeding cassette 17 provided at a lower portion of the image forming apparatus and are separated and fed one by one from the sheet feeding cassette 17 by a sheet feeding roller 18, thus being fed to conveying rollers 19. The conveying rollers 19 send the fed sheet 110 between the intermediary transfer belt 13 and the secondary transfer roller 15. Here, as shown in FIG. 2, the secondary transfer roller 15 is in a state in which it press-contacts the intermediary transfer belt 13.

Further, the voltage of the opposite polarity to the toner charge polarity has been applied to the secondary transfer roller 15, so that the above-described four color toner images superposed on the intermediary transfer belt 13 are secondary-transferred onto the surface of the conveyed sheet 110.

The sheet 110 on which the toner images are transferred is sent to a fixing device 20. In the fixing device 20, the sheet 110 is heated and pressed simultaneously, so that the toner images are fixed on the sheet 110. As a result, an image is formed on the sheet 110. Thereafter, the sheet 110 is discharged from the fixing device 20 to a sheet discharge portion 21 outside the image forming apparatus 11.

(Developing Cartridge)

Figure 14:
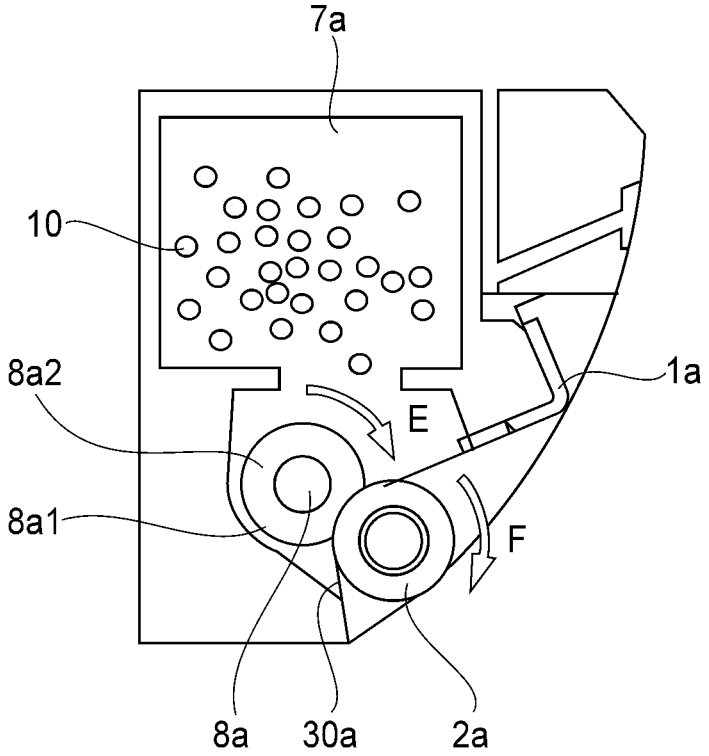
FIG. 14 is a schematic sectional view showing details of the developing cartridge in the present invention when the developing cartridge is in a developing attitude.
Figure 15:
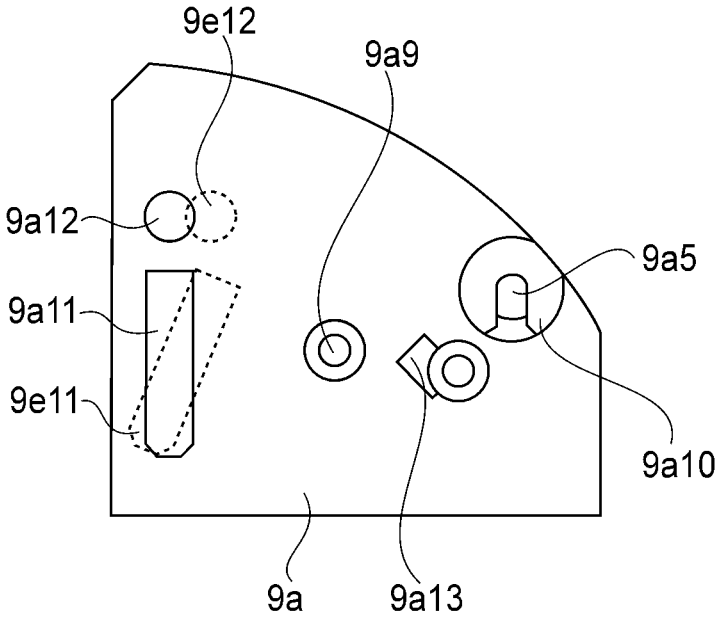
FIG. 15 is a schematic view showing a side surface of the developing cartridge in the present invention.

All the constitutions of the yellow developing cartridge 5*a*, the magenta developing cartridge 5*b*, the cyan developing cartridge 5*c* and the black developing cartridge 5*d* are the same. Therefore, the description of the constitutions of the developing cartridges will be made with respect to the yellow developing cartridge 5*a*. The yellow developing cartridge 5*a* is illustrated in FIGS. 3 and 4, and a sectional view thereof is illustrated in FIG. 14.

Figure 3:
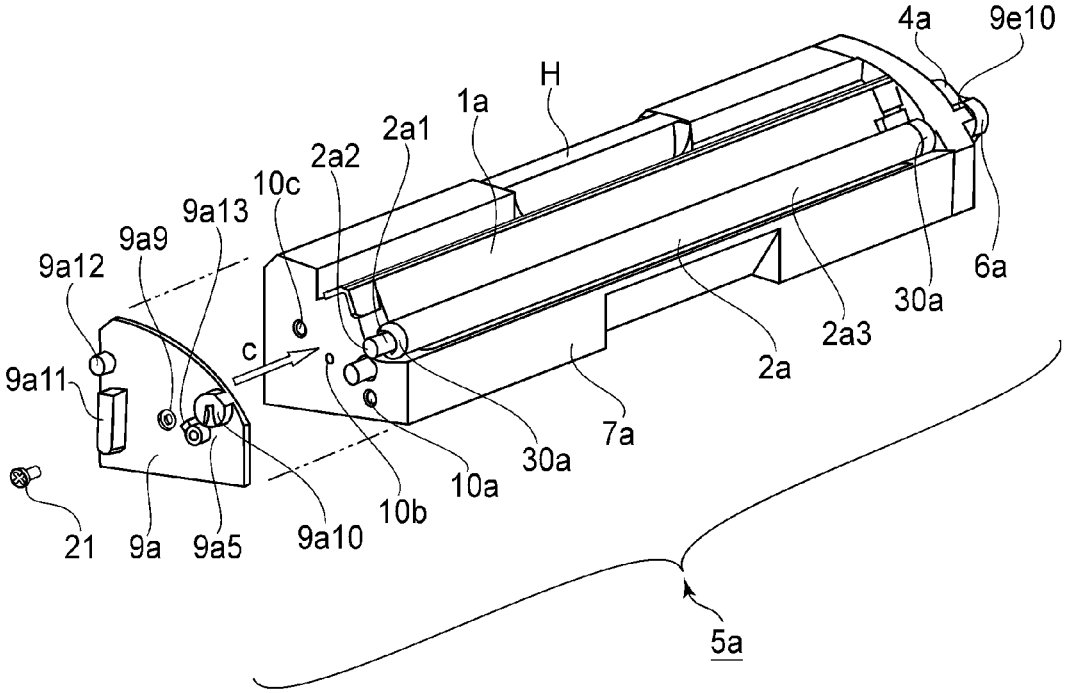
FIGS. 3 and 4 are schematic views showing a state of assembly of a developing cartridge in the present invention.

The developing roller 2*a* is, as shown in FIG. 3, constituted by a rubber roller portion 2*a*3 and a rigid member shaft 2*a*1. The rigid member shaft 2*a*1 penetrates the rubber roller portion 2*a*3 with respect to the rotational axis direction of the developing roller 2*a* to create a projected portion (an end portion having an end surface 2*a*2 of the rigid member shaft 2*a*1 shown in FIG. 3) projected from the rubber roller portion 2*a*3 at its one end portion.

Incidentally, the rigid member shaft 2*a*1 of the developing roller 2*a* similarly has the projected portion at its other end portion.

Figure 4:
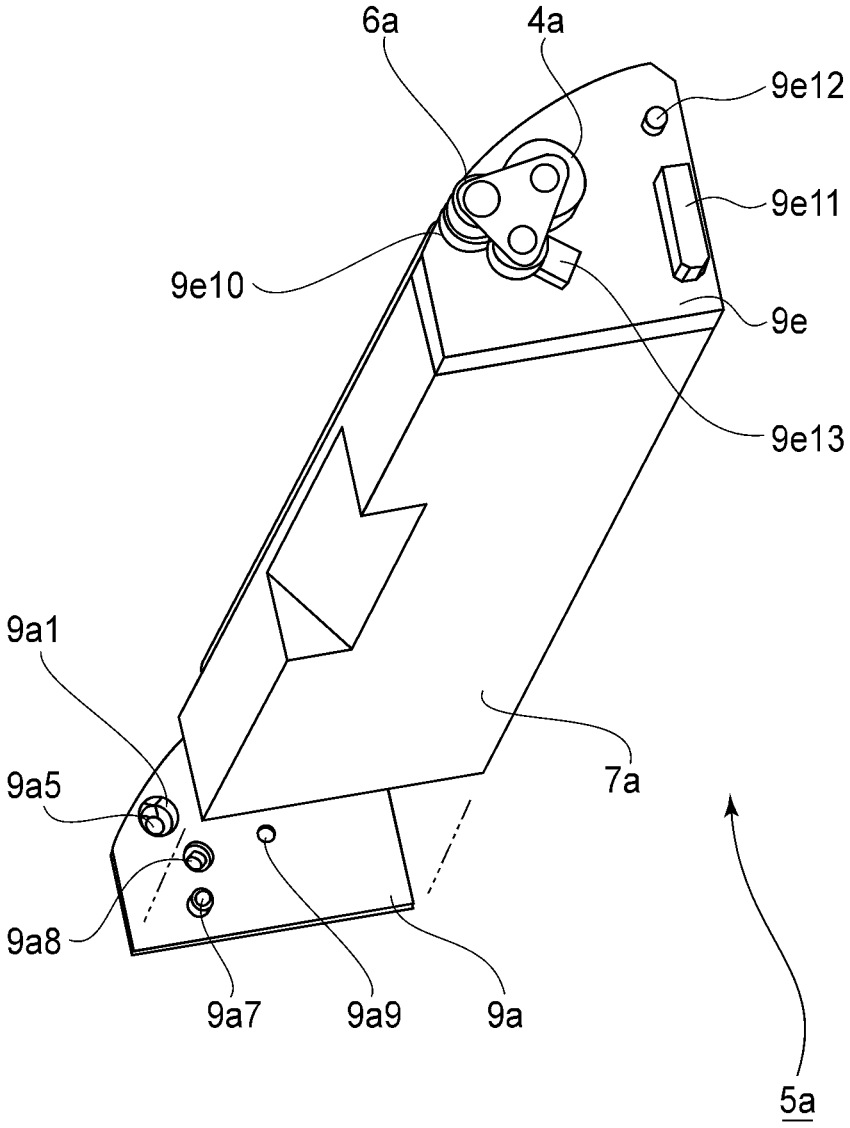

Further, the developing roller 2*a* is rotationally held by engagement between the end portion of the rigid member shaft 2*a*1 and a bearing portion 9*a*10 of a developing roller bearing 9*a* shown in FIGS. 3 and 4 and by engagement between the other end portion (not shown) of the rigid member shaft 2*a*1 and a bearing portion (not shown) of a developing roller being 9*e*.

That is, with respect to the developing roller bearing 9*a*, a boss 9*a*7 shown in FIG. 4 is engaged with a hole 10*a* and an unshown boss provided on the bearing 9*a* is engaged with a hole 10*c*, so that the bearing 9*a* is positioned on the developer container 7*a*. Thereafter, a screw 21 is caused to pass through a hole 9*a*9 and enter a screw hole 10*b*, so that the developing roller bearing 9*a* and the developing container 7*a* are fixed integrally. Further, by a similar constitution, the opposite developing roller bearing 9*e* is fixed on the developing container 7*a*.

Next, a developing operation in the developing cartridge will be described with reference to FIG. 14.

FIG. 14 is a principal sectional view of the developing cartridge 5*a* during the developing operation.

As shown in FIG. 14, toner 10 in the developing container 7*a* is fed to a toner feeding roller 8*a*, and the toner feeding roller 8*a* feeds the toner 10 to the developing roller 2*a* by rotating in a direction indicated by an arrow E in FIG. 14.

The developing roller 2*a* rotates in a direction indicated by an arrow F, so that the toner 10 on the developing roller 2*a* is regulated by a developing blade 1*a* and is subjected to the development of the electrostatic latent image formed on the photosensitive drum 3*a*.

The toner 10 left on the developing roller 2*a* after the development is removed by the toner feeding roller 8*a*. Thereafter, the toner is fed again to the developing roller 2*a* by the toner feeding roller 8*a*. The developing roller 2*a* rotates in the arrow F direction in FIG. 14 and contacts the photosensitive drum 3*a*, thus developing the electrostatic latent image with the toner.

Further, to the developing roller 2*a*, a helical gear 6*a* is integrally attached. As shown in FIG. 4, an input gear 4*a* and the helical gear 6*a* are engaged with each other, so that the developing roller 2*a* is rotated by rotation of the input gear 4*a* which has received a driving force from an unshown main assembly driving source.

Incidentally, with respect to the developing roller 2*a*, in order to provide the potential difference between the developing roller 2*a* and the photosensitive drum 3*a*, an electrical contact 105*a* of the image forming apparatus 11 shown in FIG. 5(*b*) contacts the end surface 2*a*2 (FIG. 3) of the core metal portion 2*a*1 to supply a voltage to the developing roller 2*a*.

The toner feeding roller 8*a* (FIG. 14) is constituted by a sponge portion 8*a*1 and a rigid member shaft 8*a*2 and similarly as in the case of the developing roller 2*a*, an electrical contact (not shown) of the image forming apparatus 11 contacts the rigid member shaft 8*a*2 to supply a voltage to the toner feeding roller 8*a*.

Further, at the developing position, as shown in FIG. 2, the yellow developing cartridge 5*a* is urged together with the rotary 101 holding the yellow developing cartridge 5*a* in the photosensitive drum 3*a* direction in order to stably bring the developing roller 2*a* into contact with the photosensitive drum 3*a*.

Incidentally, in order to uniformly develop the latent image on the photosensitive drum 3*a*, it is important that the developing roller 2*a* uniformly contacts the photosensitive drum 3*a* over the entire longitudinal area (i.e., in a direction parallel to the developing roller rotational axis). As a result, the developing roller 2*a* of the yellow developing cartridge 5*a* is in a state in which the developing roller 2*a* contacts the photosensitive drum 3*a* with a predetermined pressure. Incidentally, details thereof will be described later.

The rotary constitution in the present invention will be described more specifically below.

Figure 9:
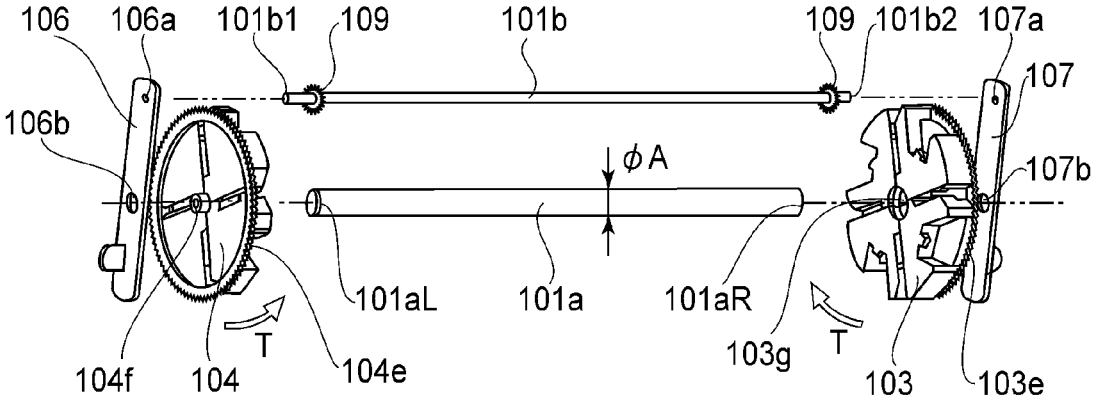
FIG. 9 is an exploded view showing a constitution of the rotary in the present invention.

As shown in FIG. 9, the first disk 104 is rotatably supported by engaging an axis 104*f*, provided at the center of the first disk 104, with a hole 106*b* of a first disk supporting member 106 (first swingable supporting member).

Further, the first disk supporting member 106 is swingably supported relative to the main assembly by engaging an end portion 101*b*1 of a shaft 101*b* with a hole 106*a* thereof. As a result, the first disk 104 is also swingable relative to the main assembly.

Similarly, the second disk 103 is rotatably supported by engaging an axis 103*f*, provided at the center of the second disk 103, with a hole 107*b* of a second disk supporting member 107 (second swingable supporting member).

Further, the second disk supporting member 107 is swingably supported relative to the main assembly by engaging an end portion 101*b*2 of the shaft 101*b* with a hole 107*a* thereof. As a result, the second disk 103 is also swingable relative to the main assembly.

The first disk 104 and the second disk 103 support the developing cartridges and positionally align the developing roller 2*a* with the photosensitive drum 3*a* so that a rotation center axis of the developing roller 2*a* and a rotation center axis of the photosensitive drum 3*a* are parallel to each other, in order that the developing roller 2*a* uniformly contacts the photosensitive drum 3*a* with respect to the longitudinal direction.

Further, each of a disk gear 104*e* provided on the first disk 104 and a disk gear 103*e* provided on the second disk 103 is engaged with an associated gear 109 integrally attached to the shaft 101*b*. The gear 109 integrally attached to the shaft 101*b* receives a rotational force from an unshown driving source to rotate the shaft 101*b*.

The disk gear 103*e* and the disk gear 104*e* have the same manner of teeth, so that both of the disks are not out of phase depending on an angle of rotation of the gear 109 and are rotated by an angle corresponding to the same angle of rotation of the gear 109. Further, between both of the disks, a rotary rotation shaft (rotation shaft member) 101*a* is provided. Further, the rotary rotation shaft 101*a* prevents tilting of the first disk 104 and the second disk 103 toward the inside thereof (in a direction indicated by arrows T in FIG. 9. Further, the rotary rotation shaft 101*a* regulates positions of both of the disks (a width distance) Z in FIG. 7(*a*)) with respect the longitudinal direction (the axis direction of the shaft 101*a*).

Further, as shown in FIG. 5(*b*), into a hole 104*g* of the first disk 104, an end portion 101*a*L of the rotary rotation shaft 101*a* is inserted.

Further, the hole 104*g* and the shaft end portion 101*a*L are engaged with each other so as to create play with respect to a radial direction, so that the shaft end portion 101*a*L is freely movable. Here, a state of the engagement will be described with reference to FIG. 17(*b*). When the rotation shaft member 101*a* has a diameter $\phi A$ and its engaging hole 104*g* has a diameter $\phi B$, these diameters satisfy: $\phi A<\phi B$. In this embodiment, a value of $\phi B-\phi A$ is set at 0.1 mm. Incidentally, this value (of the play) may be appropriately set at a proper value depending on a state of the image forming apparatus.

Figure 7:
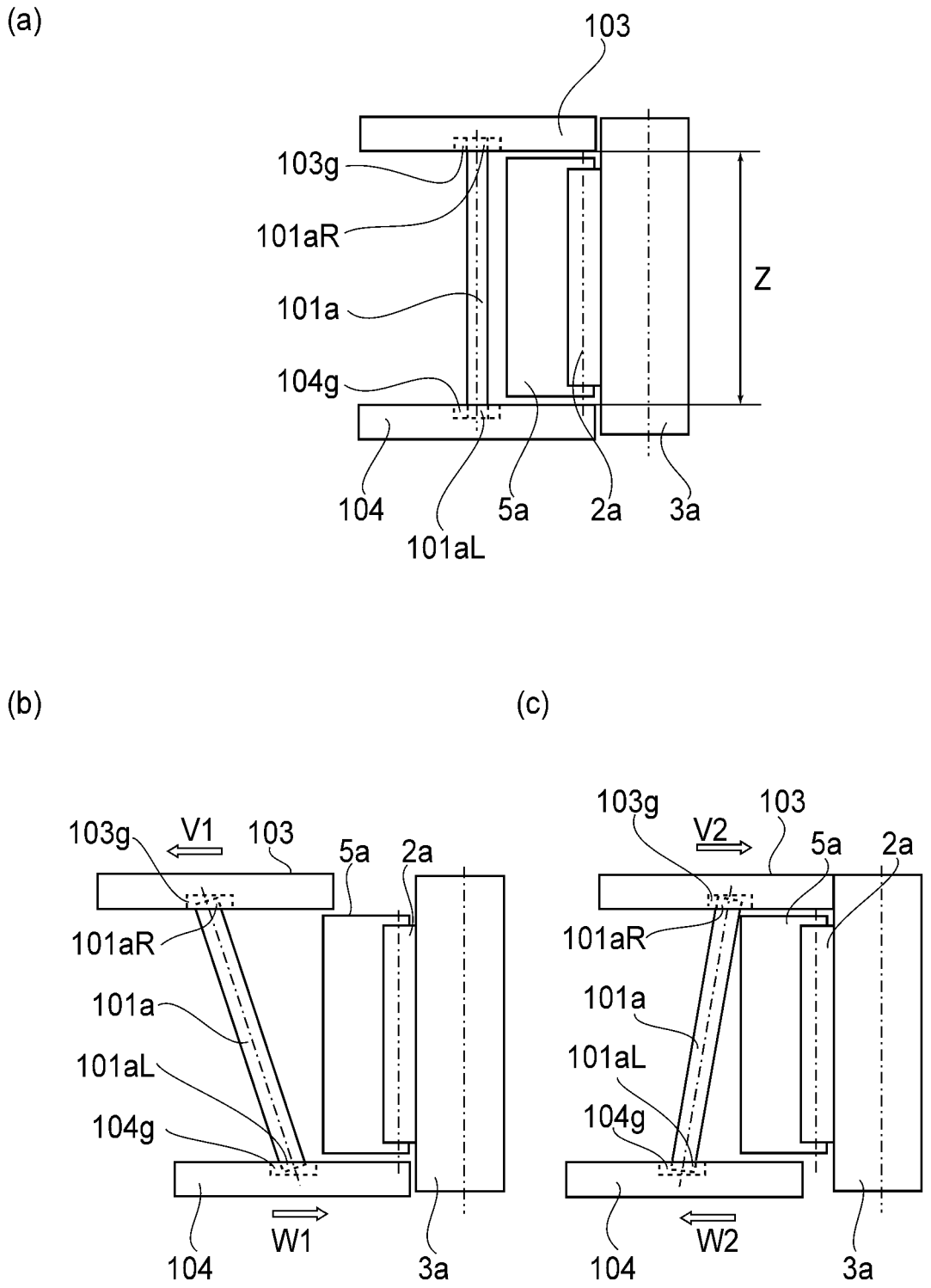
FIGS. 7(*a*) to 7(*c*) are schematic views for illustrating motion of a rotary in the present invention.
Figure 8:
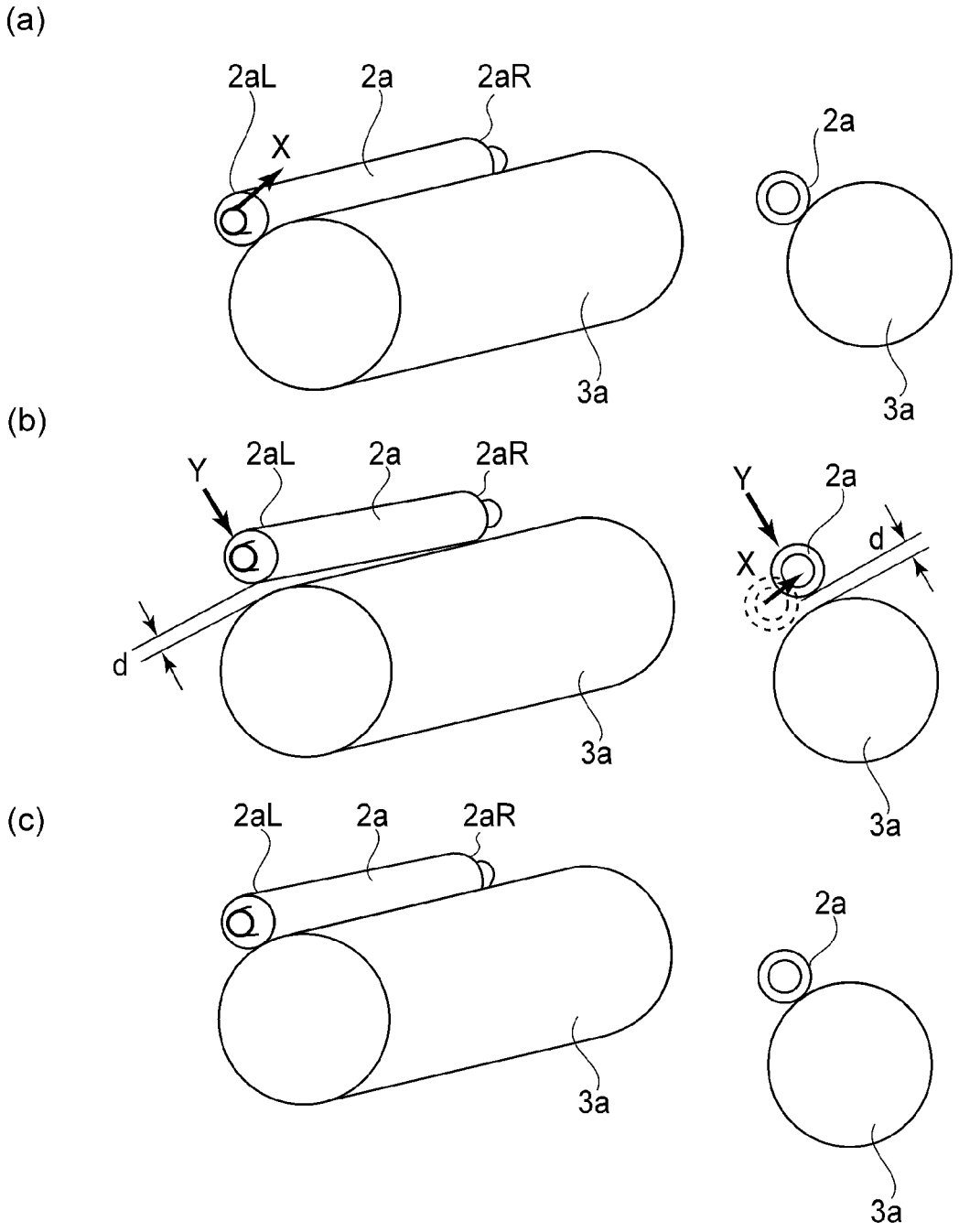
FIGS. 8(*a*) to 8(*c*) are schematic views for illustrating contact between a developing roller and a photosensitive drum in the present invention.

For that reason, as shown in FIG. 7(*c*), e.g., the disk 103 is located on the photosensitive drum 3*a* side and the disk 104 is located at a position in which the disk 104 is spaced from the photosensitive drum 3*a* relative to the disk 103 (with respect to a direction indicated by an arrow W2). Further, even in the case where the rotary rotation shaft 101*a* is tilted, the end portion 101*a*L moves within the hole 104*g* and an end portion 101*a*R moves within a hole 103*g*, so that movement of the disk 104 in the W2 direction in FIG. 7(*c*) is not prevented.

Further, on an opposite side, similarly, as shown in FIG. 9, the end portion 101*a*R of the rotary rotation shaft 101*a* is engaged with the hole 103*g* of the first disk 103 with the play.

Further, as shown in FIG. 7(*b*), e.g., the disk 104 is located on the photosensitive drum 3*a* side and the disk 103 is located at a position in which the disk 103 is spaced from the photosensitive drum 3*a* relative to the disk 104 (with respect to a direction indicated by an arrow W1). Further, even in the case where the rotary rotation shaft 101*a* is tilted, the end portion 101*a*L moves within the hole 104*g* and an end portion 101*a*R moves within a hole 103*g*, so that movement of the disk 103 in the W1 direction in FIG. 7(*b*) is not prevented.

Figure 10:
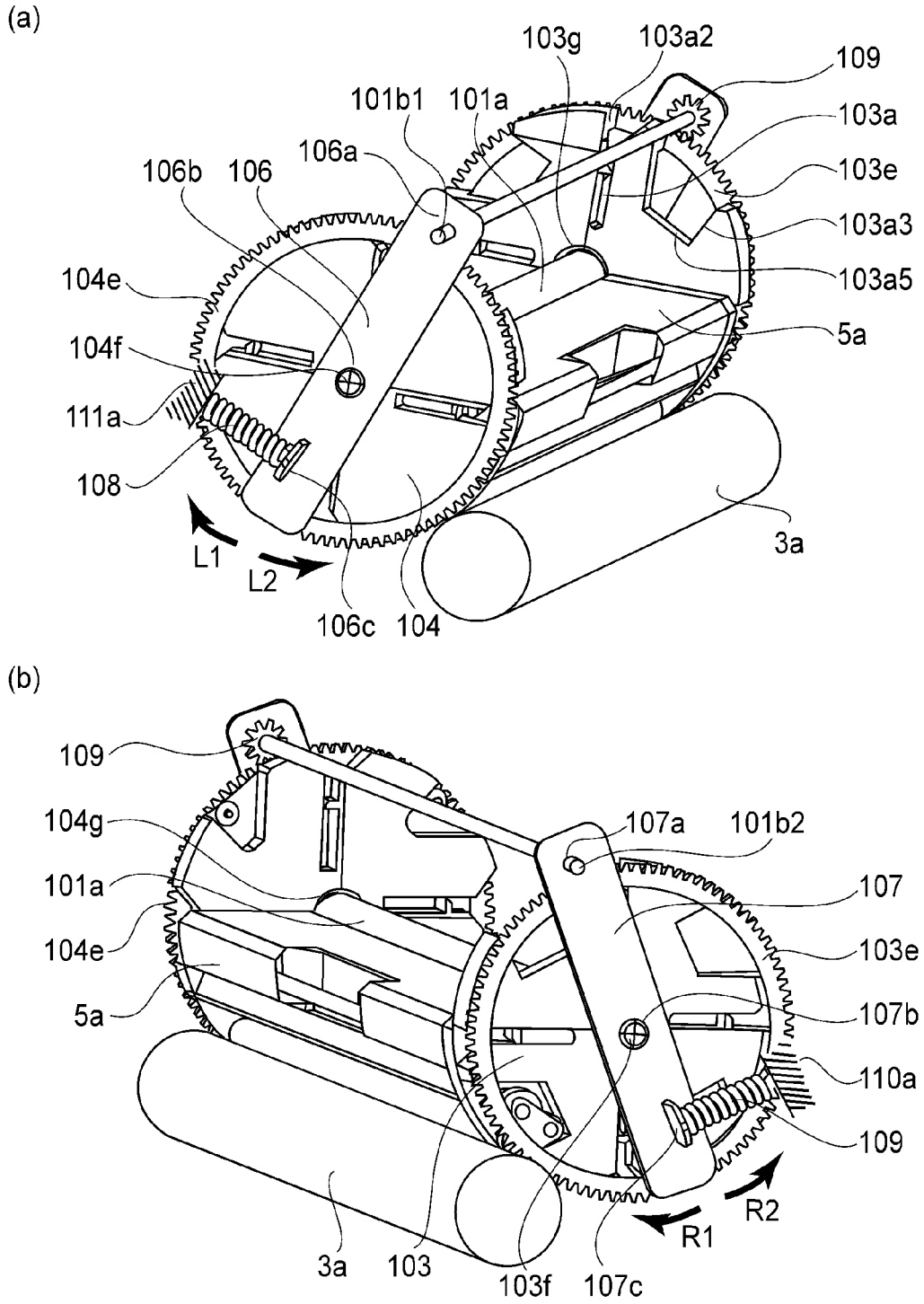
FIGS. 10(*a*) and 10(*b*) are schematic views for illustrating motion of the rotary in the present invention.

For that reason, the first disk 104 and the second disk 103 are independent of each other and do not interfere with each other, so that the first disk 104 is swingable in directions indicated by arrows L1 and L2 in FIG. 10(*a*) and the second disk 103 is swingable in directions indicated by arrows R1 and R2 in FIG. 10(*b*).

A state in which the developing roller 5*a* is mounted in the thus constituted rotary is shown in FIGS. 10(*a*) and 10(*b*). Incidentally, in these figures, for convenience of easy understanding of states of the respective parts, only one of the developing cartridges is disposed and moved to the developing position. The positioning of the developing cartridge will be described later.

As described above, the rotary 101 is positioned swingably relative to the main assembly by the shaft end portions 101*b*1 and 101*b*2, and the first disk 104 and the second disk 103 are connected by the rotary rotation shaft 101*a* with the play described above. By employing such a constitution, the first disk 104 is movable in the arrow L2 direction in which the developing roller 2*a* contacts the photosensitive drum 3*a* and in the arrow L1 direction in which the developing roller 2*a* is spaced from the photosensitive drum 3*a*. Further, the second disk 103 is configured to be movable in the arrow R1 direction in which the developing roller 2*a* contacts the photosensitive drum 3*a* and in the arrow R2 direction in which the developing roller 2*a* is spaced from the photosensitive drum 3*a*. At this time, motion of the first disk 104 and motion of the second disk 103 do not influence each other and the disks 104 and 103 are independently swingable about the shaft 101*b* as the rotation center.

Incidentally, as described above, the first disk 104 and the second disk 103 are engaged with the rotation shaft member 101*a* with the play. For this reason, the first disk 104 and the second disk 103 are not constrained by the rotation shaft member 101*a* with respect to the direction in which each of the disks is spaced from the rotation shaft member 101*a* with respect to the rotational axis direction. Therefore, there is a need to devise a means for preventing the first disk 104 and the second disk 103 from being detached from the rotation shaft member 101*a*.

Figure 17:
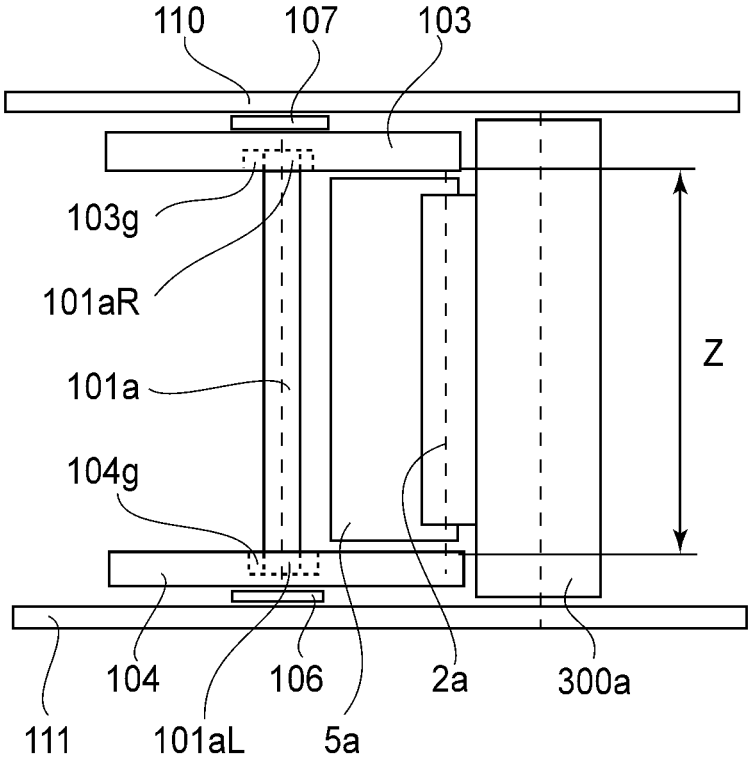
FIGS. 17(*a*) and 17(*b*) are schematic views for illustrating a supporting constitution of the rotary in the present invention.
Figure 17:
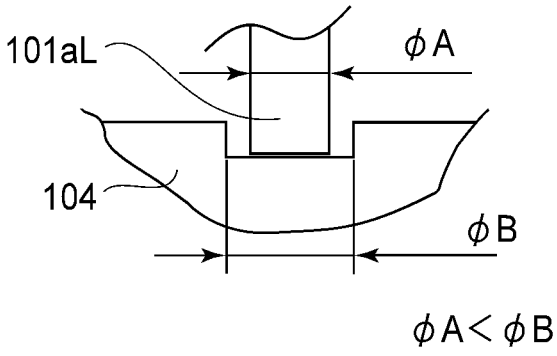

In this embodiment, a constitution as shown in FIG. 17(*a*) is employed. A main assembly left-side frame (first preventing portion) 111 is provided in proximity to or in contact with the first swingable supporting member 106 for supporting the first disk 104. By this constitution, the first swingable supporting member 106 and the first disk 104 are prevented from moving in the direction in which they are spaced from the rotation shaft member 101*a*. A main assembly right-side frame (second preventing portion) 110 is provided in proximity to or in contact with the second swingable supporting member 107 for supporting the second disk 103. By this constitution, the second swingable supporting member 107 and the second disk 103 are prevented from moving in the direction in which they are spaced from the rotation shaft member 101*a*.

Further, to the disks 104 and 103, in order to bring the developing roller 2*a* into contact with the photosensitive drum 3*a* with reliability, an urging spring (first urging member) 108 and an urging spring (second urging member) 109 are provided, respectively. These springs are referred to as an urging portion.

The spring 108 is fixed on a receiving surface 111*a* (FIG. 10(*a*)) fixed on the main assembly frame at its one end and contacts a pressure-receiving surface 106*c* provided on the first disk supporting member 106 at its the other end, thus applying a force toward the photosensitive drum 3*a*.

Further, the spring 109 is fixed on a receiving surface 110*a* (FIG. 10(*b*)) fixed on the main assembly frame at its one end and contacts a pressure-receiving surface 107*c* provided on the second disk supporting member 107 at its the other end, thus applying a force toward the photosensitive drum 3*a*.

As a result, the first disk 104 and the second disk 103 receive the force toward the photosensitive drum 3*a*, so that the force is applied to the developing cartridge positioned between the disks 104 and 103 and thus the developing roller 2*a* contacts the photosensitive drum 3*a*.

Further, at this time, as shown in FIG. 3, at each of both end portions of the developing roller 2*a*, a roller (contact portion) 30*a* having an outer diameter smaller than that of the rubber roller portion 2*a*3 of the developing roller 2*a* is attached. For that reason, the developing roller 2*a* urged toward the photosensitive drum 3*a* is deformed until the rollers 30*a* contact the photosensitive drum 3*a*. That is, by the presence of the rollers 30*a*, an amount of deformation of the rubber roller portion 2*a*3 becomes constant. In this embodiment, the contact portion is the rollers 30*a* but is the surface of the developing roller 2*a* in the case where there are no rollers 30*a*.

(Positioning of Developing Cartridge)

The positioning of the developing cartridge used in the constitution in this embodiment will be described more specifically.

As described above, the developing cartridge 5*a* is provided with the first guide portion (first portion to be guided) 9*a*11 engageable with the first guide groove (first guide portion) 104*a* and is provided with the second guide portion (second portion to be guided) 9*e*11 engageable with the second guide groove (second guide portion) 103*a*.

Figure 11:
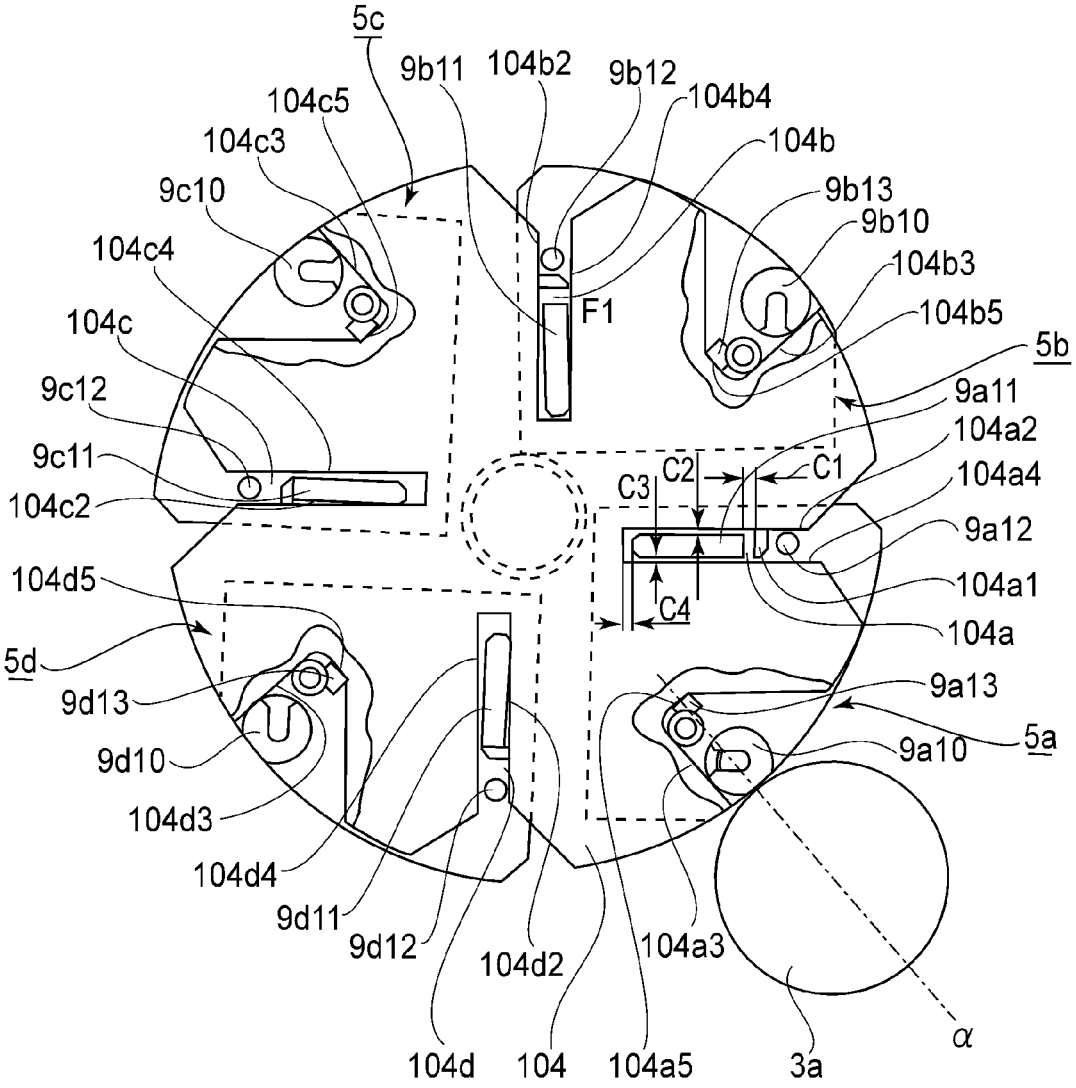
FIG. 11 is a schematic side view showing details of the rotary in the present invention when the rotary is viewed from a side surface side of the rotary.

FIG. 11 is a side view showing a state in which the developing cartridges are mounted in the rotary.

The developing cartridge 5*a* is located at the developing position, in which the developing roller 2*a* receives reaction force from the photosensitive drum 3*a* due to the above-described pressure of the urging spring 108. As a result, an outer circumferential portion of the boss 9*a*10 which is the first portion to be supported moves on a first surface 104*a*3 which is parallel to a line a connecting a center 2*a*1 of the developing roller 2*a* and a center 3*a*1 of the photosensitive drum 3*a* shown in FIG. 12.

Figure 13:
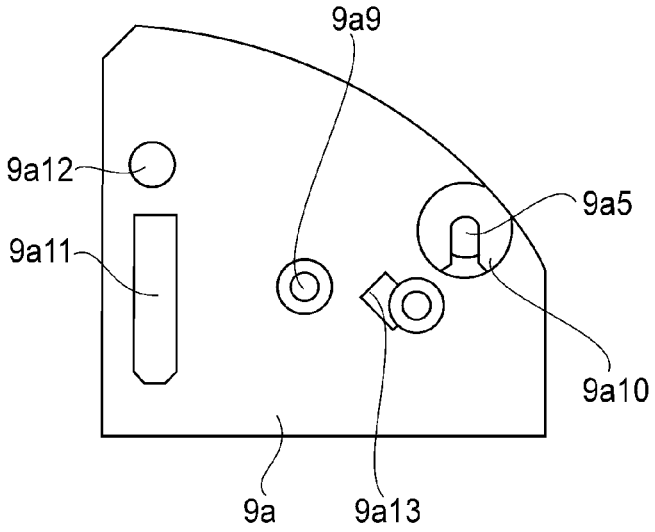
FIG. 13 is a schematic view showing a side surface of the developing cartridge in the present invention.
Figure 12:
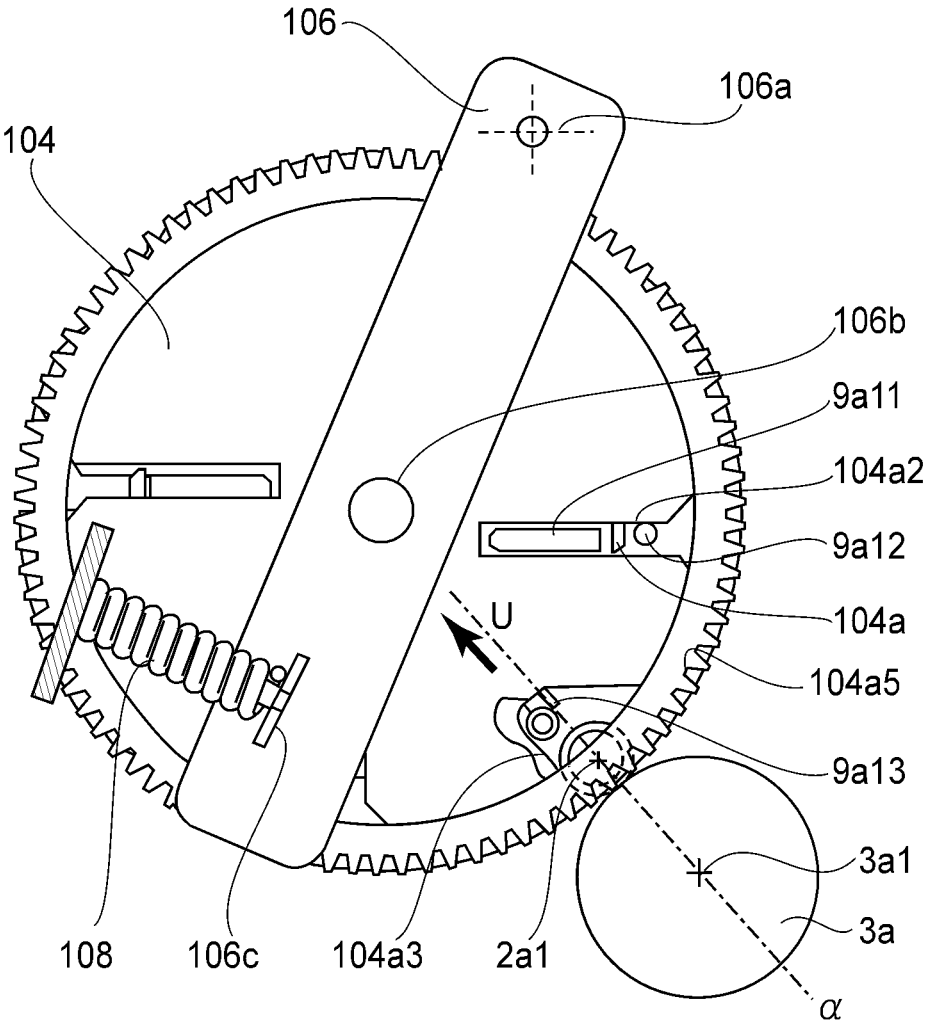
FIG. 12 is a schematic view showing details of the rotary in the present invention.

Then, the developing cartridge 5*a* moves in a direction indicated by an arrow U shown in FIG. 12, so that an abutting portion (FIG. 13) 9*a*13 which is provided on the developing roller bearing 9*a* and is a second portion to be supported, and a force-receiving portion 104*a*5 which is provided on the first disk 104 and is a second surface contact each other.

Further, a boss (third portion to be supported) 9*a*12 is provided in the guide groove 104*a* shown in FIG. 11. Then, the boss 9*a*12 contacts a third surface 104*a*2 which forms an acute angle between itself and the first surface 104*a*3 which are disposed opposed to each other, so that an attitude of the developing cartridge at one end is determined.

On the other hand, also on the other end side of the developing cartridge, the same supporting constitution as that on the above-described one end side, i.e., the support constitutions on both end sides have a bilaterally symmetrical constitution. On the other end sides of the developing cartridge shown in FIG. 4, an outer circumferential surface of a boss 9*e*10 which is a fourth portion to be supported contacts a fourth surface 103*a*3 (FIG. 10) which is a surface parallel to the line α connecting the center of the developing cartridge 2*a* and the center of the photosensitive drum 3*a*. Further, a fifth portion to be supported 9*e*13 (FIG. 4) provided on the developing cartridge contacts a fifth surface 103*a*5 (FIG. 10) provided on the disk 103. Further, a sixth portion to be supported 9*e*12 (FIG. 4) provided on the developing cartridge contacts a sixth surface 103*a*2 (surface present in the guide groove 103*a* by which the portion to be guided 9*e*11 is guided during the mounting of the developing device) provided on the disk 103.

Here, a corresponding relation among these constituent elements on one side and on the other side is summarized. The first portion to be supported 9*a*10 corresponds to the fourth portion to be supported 9*e*10. The first surface 104*a*3 corresponds to the fourth surface 103*a*3. The second portion to be supported 9*a*13 corresponds to the fifth portion to be supported 9*e*13. The second surface 104*a*5 corresponds to the fifth surface 103*a*5. The third portion to be supported 9*a*12 corresponds to the sixth portion to be supported 9*e*12. The third surface 104*a*2 corresponds to the sixth surface 103*a*2. These corresponding constituent elements have the same functions on both end sides.

Incidentally, in this embodiment, a line of intersection of the first surface 104*a*3 and the third surface 104*a*2 is configured to be in parallel to the rotational axis of the developing roller 2*a*.

Further, as described above, the disks have the same constitution on both sides of the developing cartridge, so that the attitude of the developing cartridge on the other side relative to the disk 103 is determined by a similar constitution (not shown).

Incidentally, the second portion to be supported 9*a*13 (FIG. 13) and the second surface 104*a*5 are positioned on the above-described line α and the second surface 104*a*5 is perpendicular to the line α. This is because the second surface 104*a*5 permits the developing roller 2*a* to efficiently receive the reaction force from the photosensitive drum 3*a* and thus as described above, the developing cartridge is fixed between the disks.

For that reason, in a state in which the developing cartridge 5*a* is positioned at the developing position, the guide groove 104*a* provided in the first disk 104 and the guide portion 9*a*11 provided on the developing cartridge 5*a* create gaps (play) C1 to C4 so that they do not contact each other. This is because the positioning of the developing cartridge 5*a* relative to the disk 104 is not prevented. Further, due to dimensional variation of respective parts of the developing cartridge 5*a*, the positions of the guide portion 9*a*11 on one end side and the guide portion 9*e*11 on the other end side are derived from each other as shown in FIG. 5 in some cases. Even when such a developing cartridge 5*a* is set at a position which is not the developing position, guide portions 9*b*11 to 9*d*11 of the developing cartridges 5*b* to 5*d* are required to be set so as not to interfere with guide grooves 104*b* to 104*d*. That is, between the guide portions 9*b*11 to 9*d*11 of the developing cartridges, which are not located at the developing position, and the guide grooves 104*b* to 104*d*, gaps (play) are created at positions corresponding to the gaps C1 to C4 of the developing cartridge 5*a*. In this embodiment, a value of C2+C3 is set at 0.4 mm. Further, a value of C1+C4 is set at 0.6 mm. Incidentally, these values of the play may be appropriately set at proper values depending on the state of the image forming apparatus.

As a result, as shown in FIG. 11, the guide portions 9*b*11 to 9*d*11 can be freely moved in the guide grooves 104*b* to 104*d*. For that reason, the first disk 104 is prevented from being forcedly distorted by the developing cartridges 5*b* to 5*d* which are not located at the developing position. Incidentally, on the other end side, a similar state is created.

That is, with respect to the developing cartridges which are not located at the developing position, the first disk 104 and the second disk 103 can independently perform an urging operation of each of the developing cartridges toward the photosensitive drum 3*a*.

Therefore, it is possible to properly position only the above-described developing cartridge located at the developing position and to bring the developing roller 2*a* into contact with the photosensitive drum 3*a* uniformly with respect to the longitudinal direction of the photosensitive drum 3*a*. As a result, only the developing cartridge located at the developing position is placed in a proper developing attitude. Thus, a force of the spring 108 is efficiently transmitted as a force for bringing the developing roller 2*a* of the developing cartridge 5*a* into contact with the photosensitive drum 3*a*.

In the case where the gaps C1 to C4 are set at extremely small values, the developing cartridges which are not located at the developing position connect the first disk 104 and the second disk 103 with no latitude. As a result, the disks 104 and 103 cannot be moved independently, so that the disks 104 and 103 forcedly distort the developing cartridge set at the developing position.

As a result, the developing roller 2*a* is caused to contact the photosensitive drum 3*a* while the position thereof is deviated, so that the developing roller 2*a* is partly spaced from the photosensitive drum 3*a*.

Incidentally, in this embodiment, an example in which the gaps C1 to C4 are created at both ends of the developing cartridges is shown but the gaps C1 to C4 may also be created at one of the ends depending on a setting method of the gaps.

By employing the above-described constitution, the first disk 104 and the second disk 103 can be independently supported movably relative to the electrophotographic photosensitive drum. For example, even when parallelism between the center axis of the shaft 101*b* and the center axis of the photosensitive drum is set with high accuracy, it is possible to prevent improper contact of the developing roller.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 250821/2009 filed Oct. 30, 2009 and 192392/2010 filed Aug. 30, 2010, which are hereby incorporated by reference.

What is claimed is:

1. An image forming apparatus, comprising:

an image bearing member on which an electrostatic image is to be formed;

a developing device including a developer container for containing a developer, a developer carrying member for developing the electrostatic image with the developer carried thereon, and a contact portion which is contactable to said image bearing member;

a movable member for rotationally moving said developing device mounted therein toward a position in which said developing device opposes said image bearing member, said movable member including a rotation shaft member, a first member which is engaged with the rotation shaft member with play at one end portion of the rotation shaft member with respect to a rotational axis direction of the rotation shaft member, a second member which is engaged with the rotation shaft member with play at the other end portion of the rotation shaft member with respect to the rotational axis direction, a first guide portion which is provided in the first member and with which a first portion to be guided which is provided at one end of said developing device is engageable with play, and a second guide portion which is provided in the second member and with which a second portion to be guided which is provided at the other end of said developing device is engageable with play;

a first swingable supporting member for rotatably supporting said movable member at the one end portion of the rotation shaft member in said movable member and for swingably supporting said movable member relative to a main assembly of said image forming apparatus;

a second swingable supporting member for rotatably supporting said movable member at the other end portion of the rotation shaft member in said movable member and for swingably supporting said movable member relative to the main assembly;

an urging portion for urging said movable member toward said image bearing member;

a first preventing member for preventing movement of the first member in the rotational axis direction; and a second preventing member for preventing movement of the second member in the rotational axis direction.

2. An apparatus according to claim 1, wherein said first swingable supporting member is configured to rotatably support the first member, and said second swingable supporting member is configured to rotatably support the second member.

3. An apparatus according to claim 2, wherein said urging portion includes a first urging member for urging said first swingable supporting member and a second urging member for urging said second swingable supporting member.

4. An apparatus according to claim 2, wherein said first preventing member is configured to prevent the movement of the first member in the rotational axis direction by contacting said first swingable supporting member, and said second preventing member is configured to prevent the movement of the second member in the rotational axis direction by contacting said second swingable supporting member.

5. An apparatus according to claim 1, further comprising a locking member for preventing said developing device mounted in said movable member from being disengaged from said movable member.

6. An apparatus according to claim 1, wherein the first member has a first surface for supporting a first portion to be supported which is provided on said developing device, a second surface for supporting a second portion to be supported which is provided on said developing device, and a third surface for supporting a third portion to be supported which is provided on said developing device, and wherein the second member has a fourth surface for supporting a fourth portion to be supported which is provided on said developing device, a fifth surface for supporting a fifth portion to be supported which is provided on said developing device, and a sixth surface for supporting a sixth portion to be supported which is provided on said developing device.

7. An apparatus according to claim 6, wherein the first surface and the second surface are disposed so as to be perpendicular to each other, and the first surface and the third surface are disposed so as to form an acute angle, and wherein the fourth surface and the fifth surface are disposed so as to be perpendicular to each other, and the fourth surface and the sixth surface are disposed so as to form an acute angle.

8. An apparatus according to claim 7, wherein the first surface and the fourth surface are disposed in parallel to a plane including a rotation center of said image bearing member and a rotation center of said developer carrying member.

* * * * *